US010267118B2

(12) United States Patent
Cleven

(10) Patent No.: US 10,267,118 B2
(45) Date of Patent: Apr. 23, 2019

(54) APPARATUS FOR INJECTING A FLUID INTO A GEOLOGICAL FORMATION

(71) Applicant: COMITT WELL SOLUTIONS US HOLDING INC., Katy, TX (US)

(72) Inventor: Peter Kris Cleven, Grand-Barachois (CA)

(73) Assignee: Comitt Well Solutions LLC, Katy, TX (US)

( * ) Notice: Subject to any disclaimer, the term of this patent is extended or adjusted under 35 U.S.C. 154(b) by 0 days.

(21) Appl. No.: 15/596,157

(22) Filed: May 16, 2017

(65) Prior Publication Data

US 2017/0254171 A1 Sep. 7, 2017

Related U.S. Application Data

(63) Continuation of application No. 14/629,184, filed on Feb. 23, 2015, now Pat. No. 9,683,424.

(51) Int. Cl.

| | |
|---|---|
| ***E21B 34/14*** | (2006.01) |
| ***E21B 43/26*** | (2006.01) |
| ***E21B 33/124*** | (2006.01) |

(52) U.S. Cl.

CPC ..... *E21B 33/124* (2013.01); *E21B 34/14* (2013.01); *E21B 43/26* (2013.01)

(58) Field of Classification Search

CPC ..... E21B 33/124; E21B 34/10; E21B 34/14; E21B 23/06; E21B 43/26; E21B 2034/067

See application file for complete search history.

(56) References Cited

U.S. PATENT DOCUMENTS 2,235,318 A * 3/1941 Halliburton ..... E21B 33/134 166/147
2,578,900 A * 12/1951 Ragan ..... E21B 33/1265 166/119
3,007,524 A * 11/1961 Boer ..... E21B 34/10 166/322
3,163,225 A * 12/1964 Perkins ..... E21B 23/06 166/123
3,398,796 A * 8/1968 Fisher, Jr. ..... E21B 33/124 166/120
3,552,718 A * 1/1971 Schwegman ..... E21B 23/08 166/332.1
3,865,188 A * 2/1975 Doggett ..... E21B 33/1243 166/147
3,934,652 A * 1/1976 Cochran ..... E21B 23/06 166/182

(Continued)

*Primary Examiner* — Jennifer H Gay
(74) *Attorney, Agent, or Firm* — Pierson IP, PLLC

(57) ABSTRACT

An apparatus to inject a fluid into a geological formation. The apparatus includes a central bore running axially through the apparatus; a normally-closed sleeve valve with a sliding sleeve, the sleeve valve configured to open at a sleeve activation pressure; an upstream packer disposed upstream from the sleeve valve; a downstream packer disposed downstream from the sleeve valve; and a normally-open bottom valve disposed downstream from the downstream packer, the bottom valve configured to block axial fluid flow at a first bore pressure. The upstream packer and the downstream packer are configured to set at a second bore pressure between the first bore pressure and the sleeve activation pressure.

5 Claims, 3 Drawing Sheets

(56) References Cited

U.S. PATENT DOCUMENTS 3,948,322 A * 4/1976 Baker ..... E21B 33/127 166/154
4,042,033 A * 8/1977 Holland ..... E21B 34/105 166/310
4,279,306 A * 7/1981 Weitz ..... E21B 37/08 166/147
4,372,390 A * 2/1983 Baugh ..... E21B 33/14 166/128
4,399,871 A * 8/1983 Adkins ..... E21B 34/06 137/539.5
4,458,752 A * 7/1984 Brandell ..... E21B 33/124 166/106
4,934,460 A * 6/1990 Coronado ..... E21B 33/1243 166/187
5,044,444 A * 9/1991 Coronado ..... E21B 33/1243 166/187
5,383,520 A * 1/1995 Tucker ..... E21B 23/006 166/142
5,921,318 A * 7/1999 Ross ..... E21B 33/124 166/126
6,655,461 B2 * 12/2003 Eslinger ..... E21B 33/124 166/305.1
7,051,812 B2 * 5/2006 McKee ..... E21B 33/08 166/186
7,234,529 B2 * 6/2007 Surjaatmadja ..... E21B 21/10 166/323
7,849,925 B2 * 12/2010 Patel ..... E21B 43/10 166/319
8,281,866 B2 * 10/2012 Tessier ..... E21B 34/08 116/319
8,540,019 B2 * 9/2013 Hofman ..... E21B 43/12 166/177.5
8,757,273 B2 * 6/2014 Themig ..... E21B 34/102 137/462
9,010,447 B2 * 4/2015 Themig ..... E21B 34/14 166/318
9,683,424 B2 * 6/2017 Cleven ..... E21B 33/124
2002/0153142 A1 * 10/2002 Eslinger ..... E21B 33/124 166/305.1
2004/0129423 A1 * 7/2004 Eddison ..... E21B 21/103 166/321
2004/0163811 A1 * 8/2004 McKee ..... E21B 33/08 166/279
2005/0224231 A1 * 10/2005 Surjaatmadja ..... E21B 21/10 166/374
2007/0051521 A1 * 3/2007 Fike ..... E21B 23/06 166/387
2008/0135248 A1 * 6/2008 Talley ..... E21B 21/10 166/285
2008/0283252 A1 * 11/2008 Guignard ..... E21B 33/124 166/381
2009/0078427 A1 * 3/2009 Patel ..... E21B 43/10 166/372
2010/0282476 A1 * 11/2010 Tessier ..... E21B 34/08 166/373
2011/0100643 A1 * 5/2011 Themig ..... E21B 34/102 166/373
2011/0278017 A1 * 11/2011 Themig ..... E21B 34/14 166/373
2012/0097397 A1 * 4/2012 Hofman ..... E21B 43/12 166/308.1
2013/0264068 A1 * 10/2013 Hanson ..... E21B 21/103 166/373
2014/0076560 A1 * 3/2014 Kenyon ..... E21B 33/13 166/281
2015/0184489 A1 * 7/2015 Resweber ..... E21B 33/146 166/289
2016/0024876 A1 * 1/2016 Ward ..... E21B 17/00 166/285
2016/0230507 A1 * 8/2016 Cleven ..... E21B 33/124

* cited by examiner

APPARATUS FOR INJECTING A FLUID INTO A GEOLOGICAL FORMATION

CROSS-REFERENCE TO RELATED APPLICATIONS

The present application claims priority to Norwegian Patent Application No. 20150182 filed Feb. 6, 2015, entitled "Apparatus for Injecting a Fluid into a Geological Formation."

STATEMENT REGARDING FEDERALLY SPONSORED RESEARCH OR DEVELOPMENT

Not applicable.

BACKGROUND

Field of the Disclosure

The present disclosure concerns a sleeve valve and an apparatus using the sleeve valve for injecting a fluid into a geological formation.

Prior and Related Art

For ease of understanding, this disclosure is described with respect to production of hydrocarbons, in particular hydraulic re-fracturing. However, the scope of the present disclosure may be used without modification in related technical fields, such as geothermal applications.

As used herein, a 'borehole' is an uncased hole drilled through several layers of rock in a geological formation onshore or offshore. The drilling is performed by rotating a drill bit at the end of a hollow drill string, i.e. a jointed pipe or coiled tubing. Several methods for rotating the entire drill string are well known and in use. Alternatively, a mud motor may rotate the drill bit. As used herein, a mud motor is any device caused to rotate by expelling a fluid, not necessarily drilling mud, through tangential openings.

A 'wellbore' is a borehole with a steel casing and/or liner cemented to the formation along all or part of its length, and a 'well' is a wellbore with any equipment required for operation. For simplicity, any steel tubing cemented to the formation is termed 'casing' in the following. After cementing, the casing is perforated at one or more zones to allow, for example, hydrocarbons to enter or water with or without additives to exit. A zone generally corresponds to a layer of porous rock, for example, shale, sandstone or limestone containing hydrocarbons.

Hydraulic fracturing and stimulation may improve the flow of hydrocarbons from the zone. These techniques may be employed before production starts, and may be repeated one or more times during the lifetime of a production well.

One or more injection wells may be located at a distance from the production well. An injection well usually has a design similar to that of a production well, and sometimes the injection well is an old production well. The process of injecting a fluid, e.g. water or liquid $CO_2$, through an injection well to maintain the pressure in a zone is known as 'enhanced oil recovery' or EOR.

Hydraulic fracturing and re-fracturing, stimulation and re-stimulation as well as EOR are examples of injection of fluid into a formation, i.e. at a pressure exceeding the ambient pressure in the formation. Other examples are injection of flue gas into an aquifer and, as mentioned above, geothermal applications.

Regardless of application, the injection of fluid comprises the steps of inserting a string into a wellbore, spanning the zone by packers, opening a sleeve valve and injecting the fluid. The fluid is supplied through a central bore within the string through radial openings in the valve. The packers uphole and downhole from the radial openings, e.g. at both ends of the perforated length of casing, must seal against the wellbore wall when an injection pressure is applied. A packer sealing in this manner is 'set'.

A typical packer comprises an elastic element that expands radially when compressed axially, and is set when the elastic element engages a wellbore wall, i.e. the rock in an uncased borehole or the casing in a cased part of the wellbore. Several methods for contracting packer elements axially are known in the art. For example, rotating a lead screw can cause one or more sleeves to move axially with respect to each other on a guiding mandrel. In another example, an area exposed to a predetermined activation pressure causes a force required to set the packer. In some packers, the force provided by the activation pressure merely activates a release mechanism, and the force required to set the packer is provided by other means, e.g. by a powerful spring.

A sleeve valve, also known as a 'sliding sleeve valve' and 'sliding sleeve', comprises a housing with radial ports and a sliding sleeve that can be shifted axially within the housing between an open position wherein the radial ports are exposed and a closed position where the sliding sleeve covers the ports. Due to their relatively simple design and operation, sleeve valves are widely used to control a radial flow into or out of a string within the wellbore.

In the following description and claims, the terms 'normally open' and 'normally closed' refer to the state of any valve, including sleeve valves, during run in. That is, a normally open valve is open during run in and activated to a closed state. Conversely, a normally closed valve is closed during run in and activated to an open state.

Known techniques for setting a packer or activating a sleeve valve include direct axial motion provided, for example, by a tool attached to a wireline, by a drop ball, by a downhole tractor or by the pressure within the central bore. Other techniques involve using fluid pressure to cause a rotation, e.g. for driving a leading screw to set a packer, or using a release mechanism as briefly described above.

In the following description and claims, the term 'control' implies a known response to an input. For example, a naïve control system could comprise a pressure sensor providing an input to an electronic controller running a feedback or feed forward algorithm, and providing a response, e.g. activating a valve. However, the known response implied by the above definition may also be provided by purely mechanical means. In particular, consider a bore valve with a flow plug and a complementary seat mounted coaxially with the central bore. In an open state, a spring maintains a distance, i.e. an annular restricted passage, between the flow plug and the seat. According to Bernoulli's principle, the increased velocity of an incompressible flow through the restricted passage causes a pressure drop. When this pressure drop applied to a working surface overcomes the spring force, the flow plug engages the seat such that the valve closes.

The packers and sleeve valve are usually separate units. In a pressure activated application, this means that a pressure operated valve must have an activation range that overlaps the activation range of a packer, and that the operational range must be kept within the overlap.

Some packers and valves depend on a chamber with air at atmospheric pressure. For example, shear pins or a radially biased lug may keep a sliding sleeve in a closed position during run in. The force required to break the shear pins or overcome the radial bias, can be achieved by a large pressure working on a small area, e.g. at the edge of the sleeve. This pressure can be approximately equal to the ambient pressure with a chamber at one bar. Some devices uses a burst disc, which breaks at a pressure significantly higher than the pressure in the ambient formation. As it would be expensive to design an entire system, including pumps and string, merely to release a sleeve, burst discs are mostly used in systems designed for high pressures anyway, e.g. systems for cementing, hydraulic fracturing and stimulation etc. There are numerous alternatives to burst disks. These alternatives typically require extensive sealing to maintain the integrity of the chamber during run in.

To illustrate some problems encountered by prior art, consider a well with several zones that need re-fracturing. The casing has deposits, e.g. scaling, that must be removed, for example by a swab cup or a milling tool. Traditionally, this requires a separate cleaning trip, i.e. running in and extracting a tool, e.g. attached to a wireline or string. After the cleaning trip, the casing is sufficiently clean for patching, i.e. to cover existing perforations to ensure that a fracturing fluid is injected at a sufficient pressure in one zone at a time. If the casing is not patched, the fracturing fluid and injection pressure is lost through numerous perforations and/or into severely fractured parts of the formation. Patching may be performed by several methods known in the art, e.g. by cementing a smaller diameter casing or liner within the old casing. The, the well is re-fractured using the same techniques as those used for the original fracturing, e.g. starting from the bottom, firing perforation shots and injecting fracturing fluid, essentially water and sand, at a pressure sufficient to cause cracks in the formation and force the sand into the cracks to keep them open. The fracturing require flow rates above those available with coiled tubing, so a rig for handling joint pipes will be needed. In addition, perforation and fracturing may require separate trips. After fracturing a zone a plug is installed above the zone, and the process is repeated until all zones are re-fractured. The plugs must be removed before a production pipe is re-inserted into the well. This can be done by milling or drilling or unsetting a mechanical plug, and either once a zone is fractured or as a separate step at the end of the re-fracturing procedure. During the entire process, the pressure within the wellbore must be maintained. This includes handling sudden pressure increases or kicks.

A re-fracturing process as described is expensive and time consuming, in some cases even too costly for a given production field, so that a production field may be abandoned for economical rather than technical reasons. Thus there is a need for a less expensive process for re-fracturing. In general, there is a need to reduce the number of trips required for maintenance, and at the same time control sudden pressure pulses that may occur during re-fracturing, stimulation, water injection etc. in the oil- and gas industry, in geothermal applications etc.

A general objective of the present disclosure is to overcome at least one of the problems above while retaining the benefits of prior art. A more specific objective is to provide an improved service tool for performing fluid injection.

SUMMARY

The above objectives are achieved by an apparatus according to claim 1.

More particularly, the disclosure provides an apparatus to inject a fluid into a geological formation. The apparatus includes a central bore running axially through the apparatus; a normally-closed sleeve valve with a sliding sleeve, the sleeve valve configured to open at a sleeve activation pressure; an upstream packer disposed upstream from the sleeve valve; a downstream packer disposed downstream from the sleeve valve; and a normally-open bottom valve disposed downstream from the downstream packer, the bottom valve configured to block axial fluid flow at a first bore pressure. The upstream packer and the downstream packer are configured to set at a second bore pressure between the first bore pressure and the sleeve activation pressure.

Here and in the following description and claims, the terms 'upstream' and 'uphole' refer to the direction toward the surface during run-in and operation, and the terms 'downstream' and 'downhole' refer to the opposite direction. Furthermore, 'a' and 'an' before a component should be interpreted as 'at least one component', whereas the term 'one' means exactly one. Thus, the apparatus may comprise one or more upstream packers and one or more downstream packers, as well as one or more sleeve valves arranged between the upstream packer(s) and the downstream packer(s).

The apparatus is an integrated service tool for fluid injection, wherein the packers and valves are adapted to each other, so that the apparatus merely needs to be connected to the end of a string, e.g. a jointed pipe or a coiled tubing, before use. This facilitates design and deployment of a fluid injection system. In addition, the apparatus facilitates operation, as further explained below.

The bottom valve is open during run-in, and thereby allows an axial flow through the central bore. This axial flow ensures circulation through the annulus between the string and the wall of the wellbore, e.g. to remove debris.

During activation, pumps at the surface increases the bore pressure, i.e. the pressure in the central bore. The bottom valve closes at the first bore pressure. Thereby, the bore pressure may increase further without regard to the conditions in the wellbore. As the pressure continues to increase, the packers are set at the second bore pressure and then the sleeve valve opens at the sleeve activation pressure, i.e. when the bore pressure acting on a sleeve piston area is sufficient to shift the sliding sleeve and uncover radial openings to permit a radial fluid flow from the central bore.

Thus, the apparatus can be set at various positions along the wellbore during one trip. In the re-fracturing example, the packers can be set upstream and downstream of a region with existing perforation so that the apparatus reuse the existing perforations for injection. This eliminates trips for patching and new perforation shots. Further, the re-fracturing may start at any point in the well, not necessarily at one end, and there is no need to remove plugs after completing the re-fracturing. As mentioned above, the flow rates required for hydraulic fracturing may require jointed pipe, and hence a relatively large rig on the surface. Thus, the present disclosure may cut significant costs and extend the lifetime of a field significantly.

Preferably, the sliding sleeve comprises a normally open first check valve configured to block a reverse flow in the upstream direction. This implies that the sliding sleeve shifts downstream to open, so that a reverse flow closes the sleeve valve and prevents reverse flow through the annulus. The pressure acting on the packers should be kept equal. Thus, the first check valve should be kept open unless as significant reverse flow occurs. Accordingly, the first check valve preferably has no bias or a small bias toward the open position.

The sliding sleeve preferably opens against a spring force from a sleeve spring configured to close the sleeve valve at bore pressures below the sleeve activation pressure. This means adapting the spring constant and extension to the sleeve piston area, and ensures that the sleeve valve closes when the bore pressure bleeds off.

The bottom valve may comprise an axially movable poppet forming a restricted passage with a corresponding seat. According to Bernoulli's principle, the pressure in the restricted passage decreases as the flow velocity increases. Thus, the closing force of the bottom valve can be adapted to suitable flow rate corresponding to the first bore pressure.

In one embodiment, the upstream packer and/or the downstream packer comprises a spring housing attached to an elastic packer element and axially movable on a spring sleeve that is axially and rotationally fixed to a sleeve valve housing. By necessity, the spring housing comprises a piston area facing away from the packer element. A pressure working on this piston area can expand the packer elements and/or increase the sealing force on the packers during injection.

An embodiment further comprises an inner filter for providing a fluid connection between the central bore and a first piston area that is fixed relative to the spring housing and is configured to compress the elastic packer element axially. The first piston area enables a bore pressure of a fluid in the central bore to compress the elastic packer element axially, and the inner filter prevents particles in the central bore fluid from entering a region containing movable components.

Various embodiments further comprise a packer spring extending axially between the spring housing and a fixed element that is fixed relative to the sleeve valve housing, wherein the packer spring is configured to retract the packer elements at bore pressures below the second bore pressure. Conversely, the packer spring stores energy when the packer elements are compressed axially. That is, the packer spring extends or compresses from equilibrium by a spring extension as the bore pressure increases. The spring extension may be larger than the axial compression of the packer elements. When the pressure drops, the packer spring provides a force sufficient to overcome possible adhesion between the packer elements and the wellbore wall before the elastic packer elements are retracted.

In some cases, the fixed element of the embodiment extends radially to an inner face of the spring housing and is located axially between the first piston area and the sleeve valve housing. The axial location of the fixed element implies that the packer spring is located between the fixed element and the end of the spring housing facing the sleeve valve housing, and hence that the packer spring is compressed when the spring housing shifts axially to compress the elastic packer element. As the fixed element extends radially to the inner face of the spring housing, it separates a compartment containing the packer spring from a compartment containing the first piston area. Thereby, a pressure difference between the compartments is possible, but not mandatory.

Certain embodiments further comprise an outer filter through the outer wall of the spring housing axially between the fixed element and the sleeve valve housing. The outer filter provides ambient pressure in the compartment containing the packer spring while preventing particles from entering into the spring housing. The first piston area is separated from this compartment by the fixed element, and can thus be exposed to a bore pressure that is greater than the ambient pressure.

The apparatus can optionally comprise a mud motor and/or cleaning tool downstream from the bottom valve. In these embodiments, an axial flow permitted between fracturing operations in may pass through a mud motor to drive a milling tool or similar device to remove scaling etc. The cleaning tool may also contain nozzles, scrapers or other tolls known in the art to clean a part of the wellbore. The purpose is primarily to ensure sealing between the packer elements and the wellbore wall, e.g. a casing.

Further features and benefits will become apparent from the dependent claims and the detailed description.

BRIEF DESCRIPTION OF THE DRAWINGS

The invention will be explained by means of exemplary embodiments with reference to the drawings, in which:

FIG. 1 is a schematic view of an apparatus according to the invention during run-in;

FIG. 3 is a longitudinal cross section of a sleeve valve during run-in;

FIG. 5 is a longitudinal cross section of a packer assembly during run-in.

DETAILED DESCRIPTION

The drawings illustrate the principles of the present disclosure, and are not necessarily to scale. For the same reason, numerous details known to one of ordinary skill in the art are omitted from the drawings and the following description.

Figure 1:
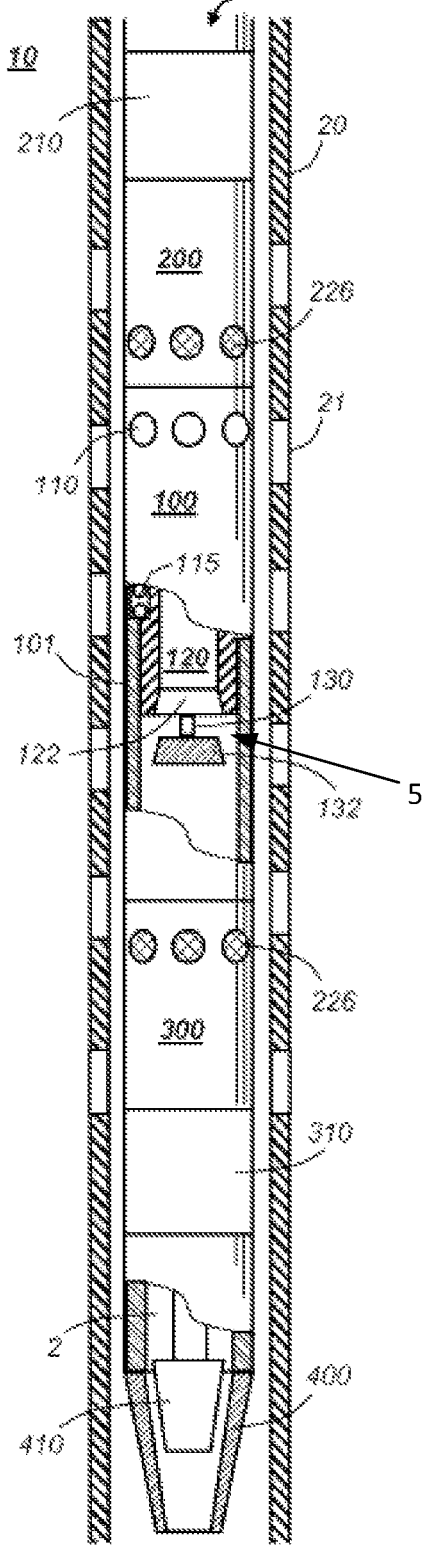

FIG. 1 illustrates an example where a casing 20 is cemented to a formation 10 with cracks (not shown), e.g. from perforation shots and previous hydraulic fracturing. The task at hand is re-fracturing. Thus, the casing 20 has perforation holes 21 in the region to be re-fractured. An apparatus 1 according to the present disclosure is attached to the end of a string. Jointed pipe is utilized in the present example, but coiled tubing may be utilized in other embodiments. Pumps at the surface provide fluid at a bore pressure through a central bore 2 in the string. The downstream and downhole directions are downward in FIG. 1.

A bottom valve 400 downstream from the downstream packer 300 is open as the apparatus 1 moves along the wellbore 20, and thus allows an axial flow through the central bore 2 to the wellbore 20. The poppet 410 is partly inserted into a funnel shaped seat within the valve 400 to create a restricted passage. According to Bernoulli's principle, the increased flow velocity through the restricted passage causes a pressure drop. The poppet 410 is spring loaded, such that the pressure drop must overcome a spring force before the poppet 410 is pulled into the closed position shown in FIG. 2. In other words, the geometry and spring force may be set to close the bottom valve at a predetermined pressure or flow referred to as the first pressure in the present description and claims.

As recognized by the skilled person, the valves controlling axial flow are variations of check valves configured and oriented in different ways. Thus, poppet 410 and other flow-plugs or blocking members and their associated seats can be replaced with any equivalents known in the art, typically part of a sphere in a frusto-conical seat. Further, adapting piston areas and, if desired springs, is largely a design issue, and hence left to the skilled person. The axial valves shown in the figures and described herein are provided as examples only.

As soon as the poppet 410 blocks the axial flow, an increased bore pressure, i.e. the fluid pressure within the central bore 2, increases the sealing force such that the bore pressure may continue rising.

Strictly speaking, Bernoulli's principle applies to 'incompressible flow'. However, both liquids and gases at low Mach-numbers are 'incompressible' in this sense, so some embodiments of the apparatus can be used to inject a gas, e.g. $N_2$.

The apparatus 1 further comprises a sleeve valve 100 arranged between an upstream packer 200 with an upstream packer element 210 and a downstream packer 300 with a downstream packer element 310. The packers 200 and 300 may have the same design and are oriented in opposite directions such that the bore pressure act symmetrically on the packers 200, 300 and sets them simultaneously at a second bore pressure. If desired, two or more upstream packers 200 may be provided upstream from the sleeve valve 100. Similarly, two or more downstream packers 300 may be provided downstream from the sleeve valve 100, and several sleeve valves 100 may be provided between the packers 200, 300.

In FIG. 1, the packer elements 210, 310 are retracted. The upstream packer element 210 is located uphole from the perforation holes 21, and the downstream packer element 310 is located downhole from the perforation holes 21. Thus, the packer elements 210, 310 are ready to be expanded as shown in FIG. 2 in order to isolate the injection zone. i.e. the region of the casing 20 provided with perforation holes 21.

A part of the sleeve valve housing 101 is removed for illustrative purposes. When the apparatus 1 is moved along the wellbore 20, e.g. during run-in, a sliding sleeve 120 is pushed upstream by a sliding sleeve spring 115, and an axial fluid flow is permitted through the sliding sleeve 120 past a normally open first check valve 122, 132.

The first check valve 122, 123 comprises a seat 122 in the downstream end of the sliding sleeve and a blocking member 132 downstream from the seat 122. The blocking member 132 is axially movable on a bracket 130 attached to the sliding sleeve 120. The purpose of the first check valve 122, 132 is to prevent a reverse fluid flow in the upstream direction. It should otherwise remain open to ensure equal pressure on the packers 200 and 300. Thus, the blocking member 132 may be unbiased or be provided with a small downward spring force to allow a small pressure difference from below, i.e. to keep the first check valve 122, 132 open until a reverse flow exceeds a predetermined limit.

Figure 2:
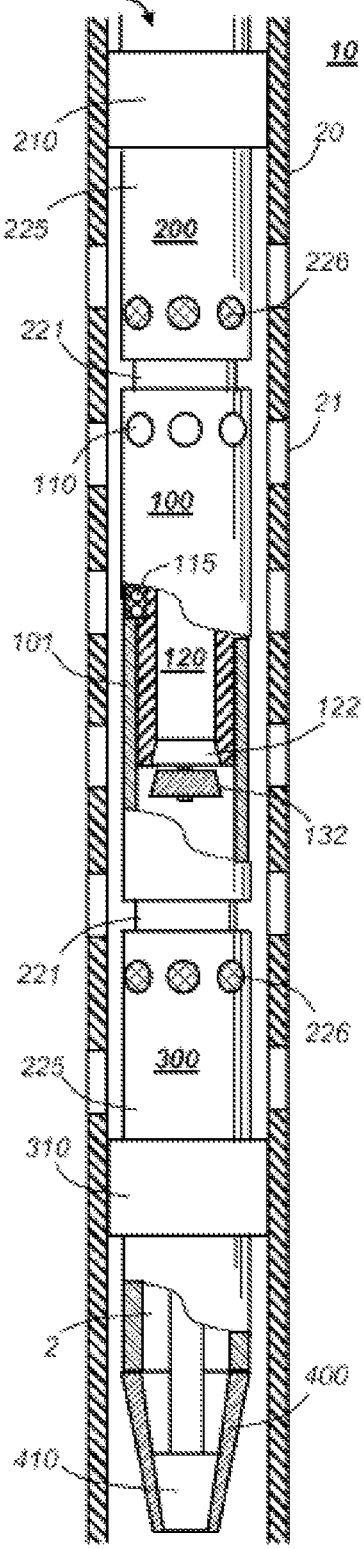
FIG. 2 shows the apparatus from FIG. 1 during operation.

FIG. 2 shows the apparatus of FIG. 1 in an operational state, i.e. ready for re-fracturing in the current example. In this state, the packers 200 and 300 are set, axial fluid flow is blocked, and radial fluid flow is permitted through the radial openings 110.

More particularly, the sleeve valve housing 101 is in the same position as in FIG. 1, and a spring housing 225 on the upstream packer 200 is shifted upstream, i.e. away from the sleeve valve housing 101, on a spring sleeve 221. This axial motion compresses the upstream packer element 210 in the axial direction, and causes it to expand radially into engagement with the inner wall of the casing 20. A similar shift of a spring housing 225 away from the sleeve valve housing 101 causes the downstream packer 300 to set. As noted above, the packers 200, 300 may have similar design and opposite orientations. In particular, the outer filters 226 on the spring housings 225 ensure that the pressure within the spring housing 225 equals the ambient pressure between the packer elements 210, 310, so the outer filters 226 need to be on the valve side of the packer elements 210 and 310. This is further explained with reference to FIGS. 5 and 6 below.

Figure 5:
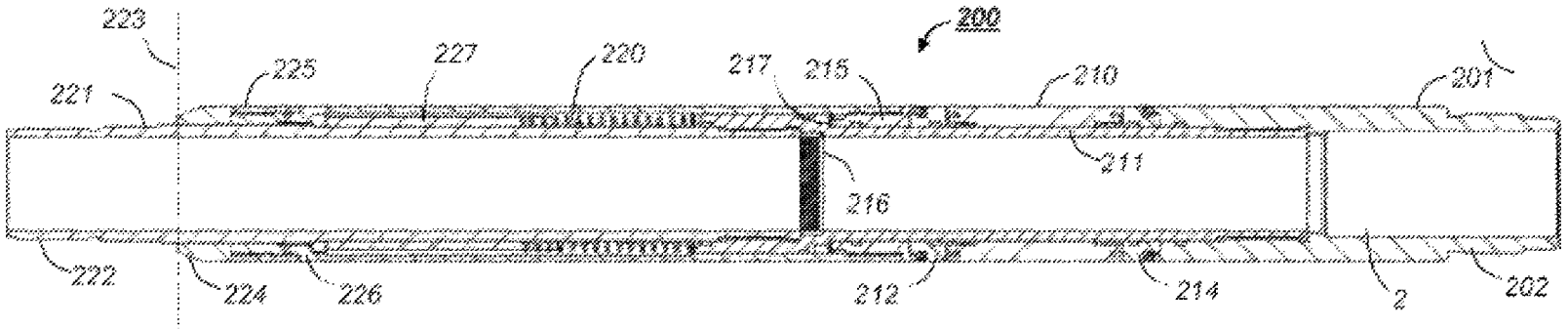
Figure 6:
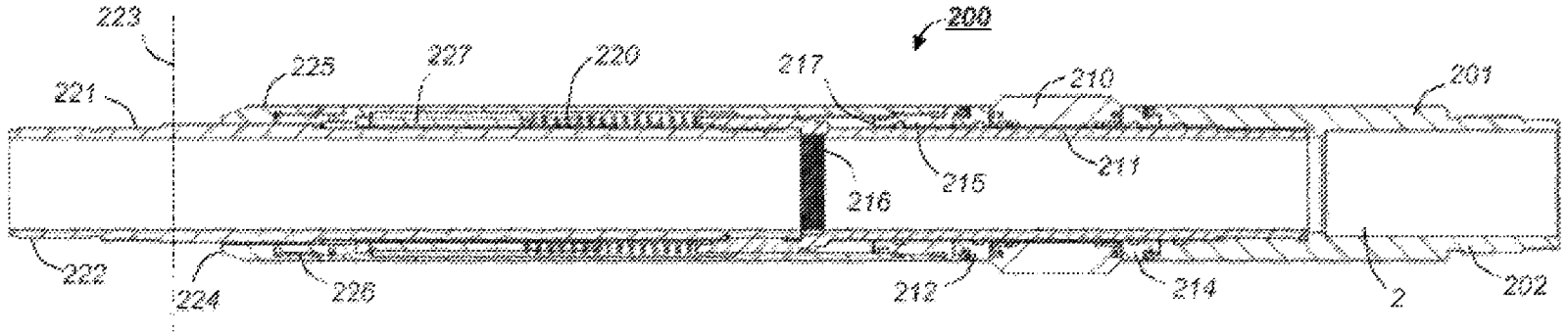
FIG. 6 shows the packer assembly in FIG. 5 during operation.

The transition from the state in FIG. 5 to the state in FIG. 6 starts when the bore pressure and/or flow past the poppet 410 exceeds a set value, causing the poppet 410 to block further axial flow as shown in FIG. 6. As the bore pressure continues to rise, the packers 200, 300 are set as explained with reference to FIGS. 5 and 6. After the packers are set, the sliding sleeve 120 shifts downstream to permit a radial flow through the radial openings 110.

As noted above, the first check valve 122, 132 generally remains open during operation to ensure equal pressure on the packers 200, 300. In FIG. 2, the blocking member 132 is shifted toward the first valve seat 122 by a reverse flow in the upstream direction. If the pressure difference causing this shift is temporary, the blocking member returns to the position shown in FIG. 1. If the pressure difference persists or is sufficiently large, i.e. if a significant reverse flow occurs, the blocking member will seal against seat 122, and the sliding sleeve 120 is pushed toward its closed position. Thus, the illustrated design blocks an axial flow through the central bore 2 and a radial flow through the openings 110 if an undesired reverse flow occurs.

After the injection is finished, the bore pressure is decreased, and sliding sleeve spring 115 returns the sliding sleeve 120 is returned to its closed position. As the bore pressure falls below the second bore pressure, a packer spring associated with the spring sleeves 221 and spring housings 225 may be configured to shift the spring housings 225 back to their initial positions, thereby returning the packer elements 210, 310 to the retracted state shown in FIGS. 1 and 5. As the packer elements 210, 310 may stick to the casing 20 and/or be slow to retract by their own elasticity after injection, the spring mechanisms ensure fast and accurate operation of the apparatus 1.

Figure 3:
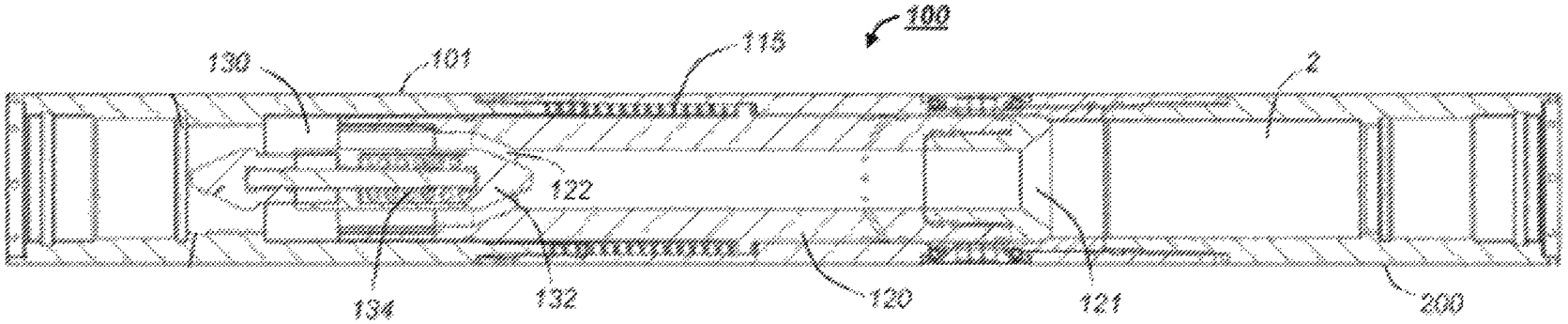

FIG. 3 is a longitudinal section of a sleeve valve 100. In addition to the components described above, FIG. 1 shows a sliding sleeve piston area 121 on the upstream end of the sliding sleeve 120. Strictly speaking, the piston area 121 is a net piston area providing a downward force on the sliding sleeve 120, i.e. a difference between an upper area and a lower area exposed to the bore pressure. For convenience, the term 'piston area' is used for similar net piston areas throughout the present disclosure.

Figure 4:
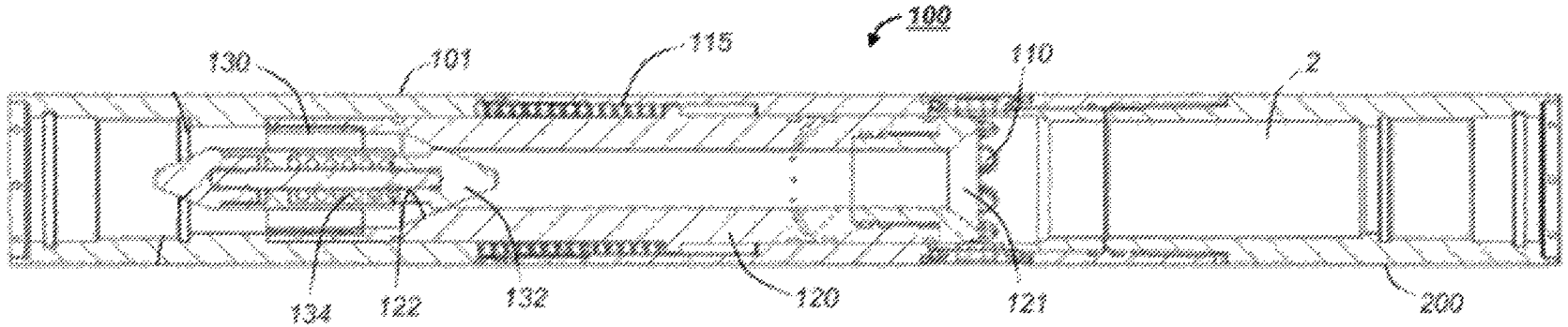
FIG. 4 shows the sleeve valve from FIG. 3 during operation.

In the embodiment shown in FIGS. 3 and 4, a biasing spring 134 provides a spring force in the downstream direction on the blocking member 132. The spring 134 returns the blocking member 132 to its open position regardless of how the apparatus is oriented with respect to gravity. If desired, additional spring force can be provided to permit small and temporary pressure fluctuations over the blocking member 132 as discussed above.

In the closed position shown in FIG. 4, the sliding sleeve 120 abuts a shoulder in the housing 101, so that no further axial motion is possible. Further, the blocking member 132 seals against the first valve seat 122. This is the state immediately after an undesired reverse flow has occurred and before the sliding sleeve has started to move away from the shoulder.

FIGS. 5 and 6 illustrate an upstream packer 200 in an unset and a set state, respectively. From a first end 202 toward a second end 222, the upstream packer 200 comprises a main housing 201, a packer section 210-216 with a packer element 210 and a spring section 220-227 with a packer spring 220. The packer section comprises an inner mandrel 211 that is fixed rotationally and axially with respect to the main housing 201. Similarly, the spring section comprises a spring sleeve 221 that is fixed rotationally and axially with respect to the main housing 201 and the inner mandrel 211. The inner diameters of the main housing 201, the inner mandrel 211 and the spring sleeve 221 form the central bore 2 through the packer element 200.

During operation, the first end 202 of the upstream packer 200 will be rotationally and axially fixed to a string, for example through a female sub (not shown) with a standard threaded box complementary to a pin at the end of a jointed pipe. Similarly, the second end 222 will be connected to the sleeve valve 100, either directly or via a sub, for example a male sub with a standard pin fitting into a standard box in the upstream end of the sleeve valve housing 101.

The upstream packer element 210 is made of an elastic material that expands radially when contracted axially. Suitable materials are known in the art, and are not further discussed herein. Alternatives to the cylindrical ring illustrated in FIGS. 5 and 6, e.g. varieties comprising several disks for use in an open hole, are also known and may be used with the present disclosure.

Packer rings 212 and 214 at either end of the packer element 210 support the packer element 210. One packer ring 212 is axially movable on the inner mandrel 211, while the other is fixed with respect to the inner mandrel 211, and thereby with respect to the string sleeve 221. This simplifies the design, Both packer rings 212, 214 are attached to the packer element 210 so that it will retract radially when the spring sleeve housing 225 shifts back to the initial position indicated by the virtual plane 223.

The piston areas at both ends of the spring housing 225 are approximately equal. When the packer element 210 is retracted as in FIG. 5, the pressure acting on the ends are also approximately equal, so the ambient pressure causes no significant net axial force on the spring housing 225. As the bottom valve 400, 410 closes as explained above, the bore pressure rises above the ambient pressure. The bore pressure acts on a piston area on a piston ring 215 through an inner filter 216. The piston ring 215 is attached to the spring housing, and essentially provides a first piston area 217 facing away from the packer element 210. The inner filter 216 provides fluid connection between the central bore 2 and the first piston area while preventing solid particles from entering the piston mechanism.

Once the bore pressure reaches a predetermined value, the piston ring 215, and thereby the movable packer ring 212, shifts away from the second end 222, i.e. the end connected to the sleeve valve housing 101 in FIG. 1. The piston ring 215 is attached to the spring housing 225, which is shifted accordingly. This axial shift causes the axial compression and radial expansion of the packer element 210 described above.

A packer spring 220, e.g. a wave spring or a Belleville spring, is disposed radially between the spring sleeve 221 and the spring housing 225. Axially, the packer spring 220 is disposed between the stationary inner mandrel 211 and the axially movable spring housing 225. Thus, the packer spring 220 is compressed when the spring housing 225 shifts from the initial position illustrated by a virtual plane 223 to the axial position shown in FIG. 6. In other words, potential energy is stored in the packer spring 220. After operation, e.g. re-fracturing, the potential energy is used to reset the packer 200 to the state in FIG. 5.

A spring spacer 227 is disposed between the end of the spring housing 225 and the packer spring 220. The length of the spring spacer 227 and the housing 225 are conveniently adapted to the zone to be spanned, while the length of the spring remain unchanged. This simplifies the design, and allows a range of lengths using a small number of standard components, e.g. springs.

In the state illustrated in FIG. 6, i.e. when the packer element 210 seals against the wellbore wall as illustrated in FIG. 2, the pressure acting on the end 224 of the spring housing 225 may advantageously be greater than the pressure acting on the opposite end. In this case, the injection pressure, i.e. the bore pressure and the ambient pressure between the set packer elements 210, 310, tends to increase the sealing force on the packer elements 210, 310. To achieve this, the faces between the movable packer ring 212 and the spring sleeve elements 215 and 225 are adapted to each other so that little or no piston area is exposed to ambient pressure at the upstream end of the spring sleeve 225. If desired, the components 212, 215, 225 may comprise additional seals for the same purpose.

After use, e.g. after the re-fracturing is completed, the bore pressure, and hence the pressure between the packers 21, 310, is decreased. At some point, the spring force from the compressed packer spring 220 overcomes the axial force acting on the piston area 224, and the potential energy stored in the packer spring 220 is released. The force and energy required to return the packer 200 to its initial state are easily measured. Then, the two equations for spring force and potential energy of a spring, i.e. $F=kx$ and $E=\frac{1}{2}kx^2$, respectively, can be solved to find suitable values for the spring constant k and the compression x.

The outer filters 226 ensure that the pressure in the compartment containing the packer spring 220 and the spring spacer 227 equals the ambient pressure at all times. This compartment is separated from a compartment containing the piston ring 215 by a section of the inner mandrel 211. Thus, there are no pressure differentials to ambient pressures, and no forces except those described above working on the system. Accordingly, the packer will work as described above within in a wide range of pressures.

The downstream packer 300 may comprise the same design as the upstream packer 200. However, on the apparatus illustrated in FIGS. 1 and 2, the downstream packer 300 is oriented the opposite way. That is, the second end 222 of the downstream packer 300 is connected to the downstream end of the sleeve valve housing 101, and the first end 201 is connected to the bottom valve assembly 400, 410.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

The invention claimed is:

1. A method for a geological formation, comprising:

positioning a normally-closed sleeve valve within an apparatus, wherein a central bore runs axially through the apparatus;

opening the normally-closed sleeve valve a sleeve activation pressure by moving a proximal end of a sliding sleeve below radial openings through the apparatus;

positioning an upstream packer upstream from the sleeve valve;

positioning a downstream packer downstream from the sleeve valve positioning a normally open bottom valve downstream from the downstream packer;

blocking, via the bottom valve, axial fluid flow at a first bore pressure, wherein the bottom valve comprises an axially movable valve body forming a restricted passage with a corresponding seat.

2. The method of claim 1, further comprising:

setting the upstream packer and the downstream packer at a second bore pressure, the second bore pressure being between the first bore pressure and the sleeve activation pressure.

3. The method of claim 2, wherein at least one of the upstream packer and the downstream packer comprises an axial force housing attached to an elastic packer element and axially movable on a moving sleeve that is axially and rotationally-fixed to an axial valve housing.

4. The method of claim 1, further comprising:

opening the sliding sleeve opens against an axial force configured to close the sleeve valve at bore pressures below the sleeve activation pressure.

5. A method for a geological formation, comprising:

positioning a normally-closed sleeve valve within an apparatus, wherein a central bore runs axially through the apparatus;

opening the normally-closed sleeve valve a sleeve activation pressure by moving a proximal end of a sliding sleeve below radial openings through the apparatus;

blocking, via a normally open first check valve, a reverse flow in the upstream direction.

* * * * *